United States Patent [19]

Mai

[11] 4,045,000

[45] Aug. 30, 1977

[54] RACK JACK

[75] Inventor: Erich Mai, Kirschfurt, Germany

[73] Assignee: Firma Josef Haamann, Hebe-und Transporttechnik, Freudenberg, M.-Kirschfurt, Germany

[21] Appl. No.: 720,807

[22] Filed: Sept. 7, 1976

[30] Foreign Application Priority Data

Sept. 11, 1975 Germany ..... 2540400

[51] Int. Cl.[2] ..... B66F 7/26

[52] U.S. Cl. ..... 254/45; 214/515

[58] Field of Search ..... 254/45, 89 R, 95, 97; 214/515, 390, 512; 294/81 SF

[56] References Cited

U.S. PATENT DOCUMENTS

| | | | |
|---|---|---|---|
| 3,541,598 | 11/1970 | Dousset | 214/392 |
| 3,744,652 | 7/1973 | Rieschel | 254/89 H |
| 3,749,363 | 7/1973 | Hauser | 254/45 |

*Primary Examiner*—Al Lawrence Smith
*Assistant Examiner*—Robert C. Watson

[57] ABSTRACT

A rack jack for hoisting, lowering and/or supporting containers, cabins, shelters, exchangeable superstructures or the like, with the corner fitting whereof pinlike engaging parts of two arms cooperate, the arms presenting respectively two supporting rods of different length, disposed at a distance from each other on the jack shaft and associated with the upper or lower corner fittings. The engaging part for the upper corner fitting is adjustable axially parallel to the axis of the jack and transversely to the jack axis, and the engaging part for the lower corner fitting is disposed perpendicularly with reference to the jack axis. The two rods of the arm that is associated with the lower corner fittings are articulatedly connected respectively with the jack shaft and the pinlike engaging part. The longer rod that in the working position runs obliquely against the jack shaft is provided with a plurality of mutually spaced articulation points in the upper half of the jack shaft, and the total length of the two rods of the arm does not exceed, or does not substantially exceed, the height of the jack shaft.

8 Claims, 4 Drawing Figures

RACK JACK

BACKGROUND OF THE INVENTION

The invention relates to a rack jack for hoisting, lowering and/or supporting containers, cabins, shelters, exchangeable superstructures or the like, with whose corner fittings pinlike engaging parts of two arms cooperate, presenting respectively two supporting rods of different length, disposed on the jack shaft at a distance from each other and associated with the upper and lower corner fittings respectively, whereby the engaging part for the upper corner fitting is adjustable axially parallel to the jack and transversely to the axis of the jack, and the engaging part for the lower corner fitting is disposed perpendicularly with reference to the jack axis.

Such rack jacks are known for example from German Gebrauchsmuster (Utility Model) Nos. 7,419,031 and 7,502,135. The shafts of these rack jacks are respectively provided at the upper and lower end with shackles to which the arms are detachably fixed by means of connecting bolts, so that after use of the jack they can be removed and separately stored. To adapt the rack jack to different container heights, it is also known that a plurality of fastening shackles can be provided for the upper arm on a jack shaft of suitable length. The disposition of these fastening shackles is fixed, i.e., bound to quite specific heights of containers etc. and, moreover, the setting up of these rack jacks requires a relatively long time and the disassembled arms are parts that can readily be lost and that require extra storage. Especially though, these known rack jacks are quite heavy, which makes them hard to handle. This is attributable to the fact that the jack shaft is relatively long and its cross section at the point of connection for the lower arm—because of the geometry of this member—must be relatively large, and this large cross section extends over the whole structural height of the jack shaft.

SUMMARY OF THE INVENTION

The present invention is therefore addressed to the problem of developing a rack jack of the described type in which the length of the shaft is referred to the height of the lowest containers etc. and the shaft cross section is relatively smaller so that the rack jack will have an acceptable total weight, and its handling will thereby be facilitated with reduction to a minimum of the number of parts that have to be put together cr disassembled. The setting up or taking down of the rack jack will therefore require little time. Moreover, the rack jack would be simply adapted to different heights of containers etc.

According to the invention, this problem is solved, for a rack jack of the described type, in that the two rods of the arm associated with the lower corner fitting are articulatedly disposed respectively on the jack shaft and the pinlike engaging part, and in that there is provision for the longer rod, that in the operating position runs slantedly upward against the jack shaft, of a plurality of mutually spaced points of articulation in the upper half of the jack shaft, and in that the total length of the two rods of the arm will not exceed or not substantially exceed the structural height of the jack shaft. Because of this last feature and the articulated disposition of the two rods of the lower arm respectively on the jack shaft and the pinlike engaging part, it is possible when use of the rack jack is completed simply to fold them against the jack shaft and detachably fasten them so that the rods, together with the jack shaft, comprise a storage unit. By this arrangement and configuration of the lower arm there is also an advantageous reduction of time expended for setting up and taking down the rack jack, as compared to the state of the art, because only the upper arm has to be assembled and disassembled as a separate structural part of the jack shaft.

In that a plurality of articulation points is furnished for the longer rod of the lower arm, the rack jack—without excessive shaft length—can also be readily adapted to different heights of containers etc., and since in addition these articulation points are provided in the upper half of the jack shaft, there is the further advantage that forces applied to the jack shaft via the lower arm will be better distributed over the structural height of the shaft, i.e., a concentration of the forces applied to the shaft from the lower arm is prevented in the lower zone of the shaft so that the shaft cross section can be made relatively small in its total height. Accordingly, the total weight of the jack is kept to an acceptable value, and easy handling is ensured.

If the two rods of the arm associated with the lower corner fittings are articulatedly disposed respectively on the jack shaft and the pinlike engaging part, and for the longer rod that in the working position runs obliquely upward against the jack shaft there is provision for only one articulation point in the upper half of the jack shaft and the rod is made to be variable in length, there is the further advantage in addition to the characteristics mentioned above, that the rack jack can be adapted continuously to most different heights of the container, etc.

The leading in of forces via the lower arm into the jack shaft is still better distributed over the height of the shaft if the articulation point/points of the rod of the lower arm that runs in its operating position obliquely upward against the jack shaft is/are disposed in the upper third of the jack shaft.

If, in the case of a rack jack with shackles at the upper end of the jack shaft for detachable fastening of the upper arm, the total length of the two rods of the lower arm is such that when the upper arm is taken off and the rods of the lower arm are in a somewhat extended position in which the said rods are close against the jack shaft, the upper end of the longer rod of the lower arm being held detachably by a shackle at the upper end of the jack shaft, there is a simple fixation of the upper end of the longer rod of the lower arm in its storage position, without additional retaining means.

In a further embodiment of the invention, to secure the rods of the lower arm in a somewhat extended storage position, an arcuate clamping strap is provided on the jack shaft which at the same time advantageously forms a retainer for the hand crank of the jack crank drive.

BRIEF DESCRIPTION OF THE DRAWINGS

The invention is described below with reference to the accompanying drawings.

DESCRIPTION OF THE PREFERRED EMBODIMENTS

Figure 1:
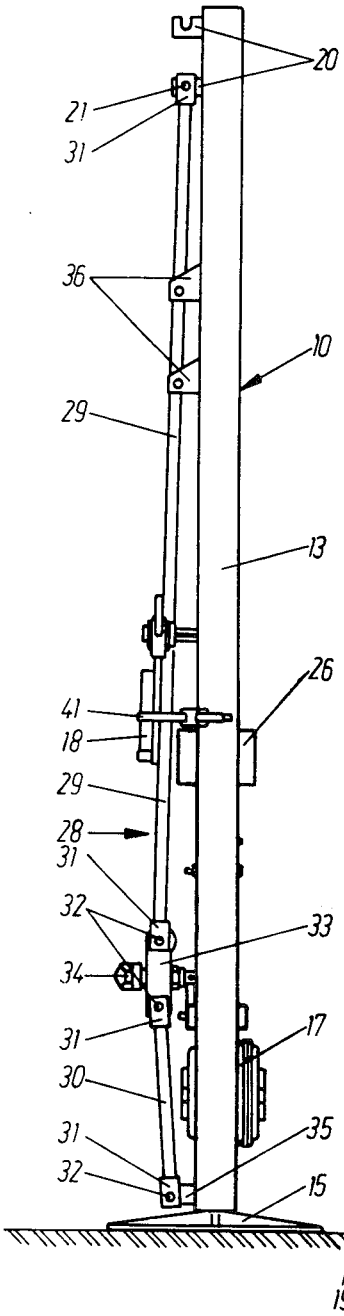
FIG. 1 is a side elevational view of the rack jack of the invention, showing the rods of the lower arm folded against the jack shaft, and the upper arm as well as the hand crank of the jack crank drive fixed on the shaft in the storage position.
Figure 2:
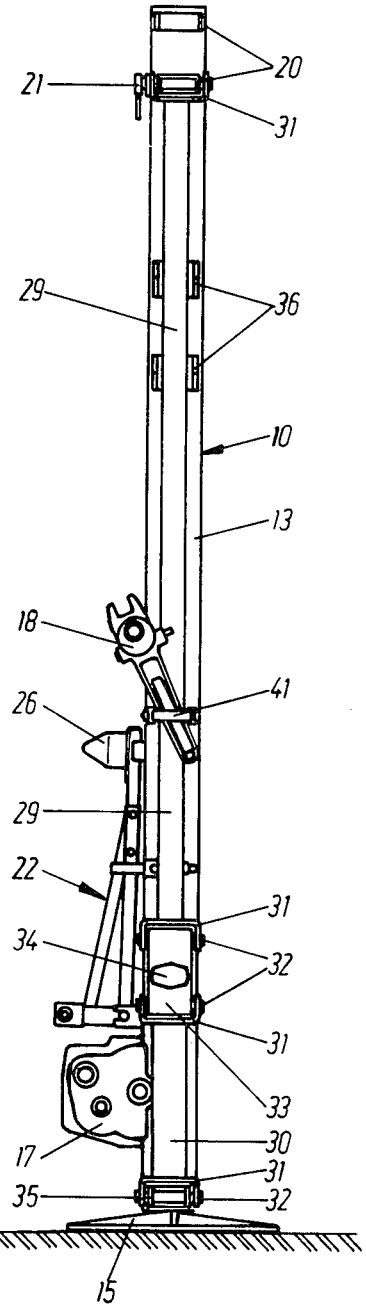
FIG. 2 is a front elevational view of the rack jack of FIG. 1.
Figure 4:
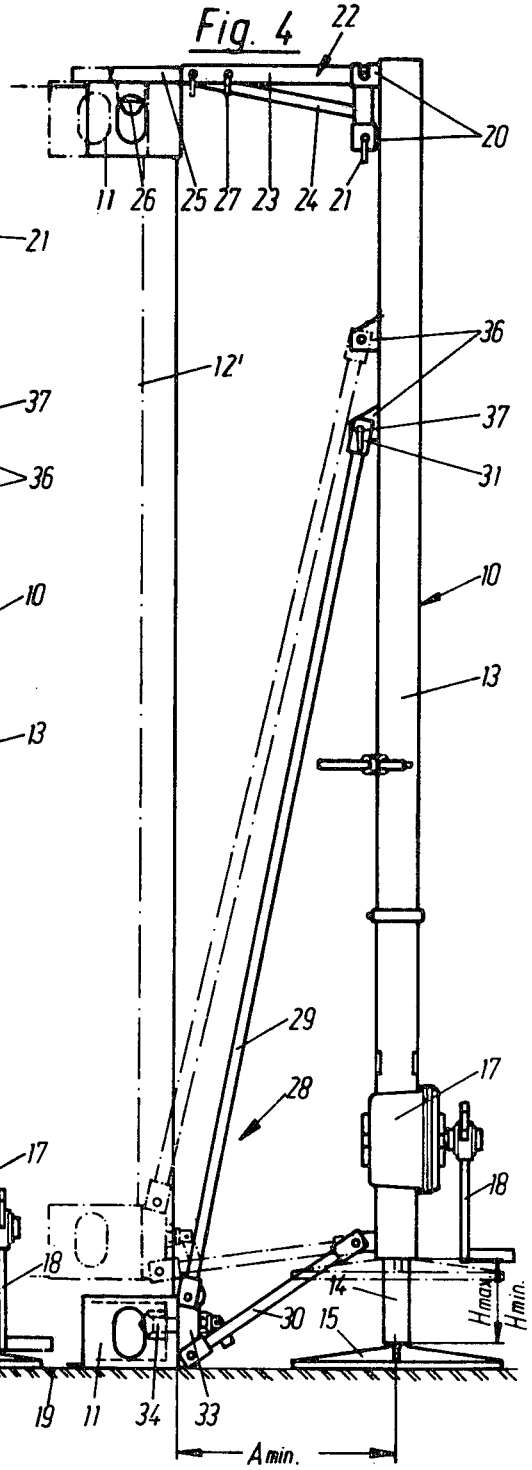
FIG. 4 is a side elevational view similar to FIG. 3 but in connection with part of a container of maximum height.

FIGS. 1 and 2 show the rack jack of the present invention in the storage position in which the two arms and the hand crank form a unit with the other parts of the rack jack, which can be disposed for instance in appropriate holders on the front of a container or the like. Rack jacks of this kind serve among other things to lift a container or the like from a loading surface, e.g., a truck, and then for example, to set it on the ground, or vice versa to lift it from the ground and set it on the loading surface. For this purpose, four rack jacks 10 are set at the standard corner fittings 11, e.g., of a container 12 or 12'. Each rack jack 10 has a shaft 13, a rack 14 (FIG. 4) with a supporting foot 15, as well as a crank drive 17 on jack shaft 13, actuatable by a hand crank 18 that can be actuated to move shaft 13 up or down along rack 14 relative to the ground 19.

On the upper end of jack shaft 13, there are two shackles 20 above which, with use of a bolt 21 that can be tightened, an upper arm 22 is detachably disposed on jack shaft 13. Arm 22 comprises two rods 23 and 24 of different length, as well as a rod 25 which supports a pinlike engaging part 26 at its free end, which part runs substantially parallel to the axis of the jack, in which an upper corner fitting 11 engages, and is adjustable transversely with reference to the jack axis. To accomplish this, rod 25 is axially displaceable in hollow rod 23, and can be locked by means of a tightenable bolt 27 in two different positions, in the examples shown in FIGS. 3 and 4 respectively. The reason why the pinlike engaging part 26 is disposed so as to be adjustable with reference to the jack axis will be explained hereinafter.

Arm 28 that is associated with the lower corner fitting 11 of container 12 or 12' has two rods 29 and 30 that present U-shaped straps 31 at their ends, by means of which rods 29 and 30 are articulatedly disposed via pin 32 on a receiver plate 33 for a pinlike engaging part 34, or a shackle 35 on the lower end of jack shaft 13. The U-shaped strap 31 on the upper end of rod 29 can be articulated selectively by means of a tightenable bolt 37 on one of the two shackles 36 that are provided in the upper third of jack shaft 13. If rods 29 and 30 are in their somewhat extended storage position as in FIGS. 1 and 2, U-shaped strap 31 is detachably connected by means of tightenable bolt 21 with lower shackle 20 on the upper end of the jack shaft. This is on the condition that the distance between shackle 35 and lower shackle 20 correspond approximately to the total length of the two rods 29 and 30 of the lower arm 28.

The pinlike engaging part 34 associated with lower corner fitting 11 is disposed substantially perpendicularly to the jack axis, extends laterally into one of the corner fittings 11, and is to a limited extent axially adjustable in receiving plate 35.

The rack jack 10 shown in FIGS. 1 to 4 is intended, for example, for two containers 12 and 12' respectively, with height H min and H max. If between the two shackles 36 additional shackles are provided, the jack will be suitable for handling containers with heights that range between H min and H max. However, it is also possible to make rod 29 in two parts and to connect these two parts by means of a turnbuckle 40, indicated by dot-and-dash lines in FIG. 3. By actuation of this turnbuckle, the length of rod 29 can be varied continuously, and adapted to containers or the like of various heights, an upper shackle 36 being sufficient for articulation of rod 29 on the jack shaft.

Figure 3:
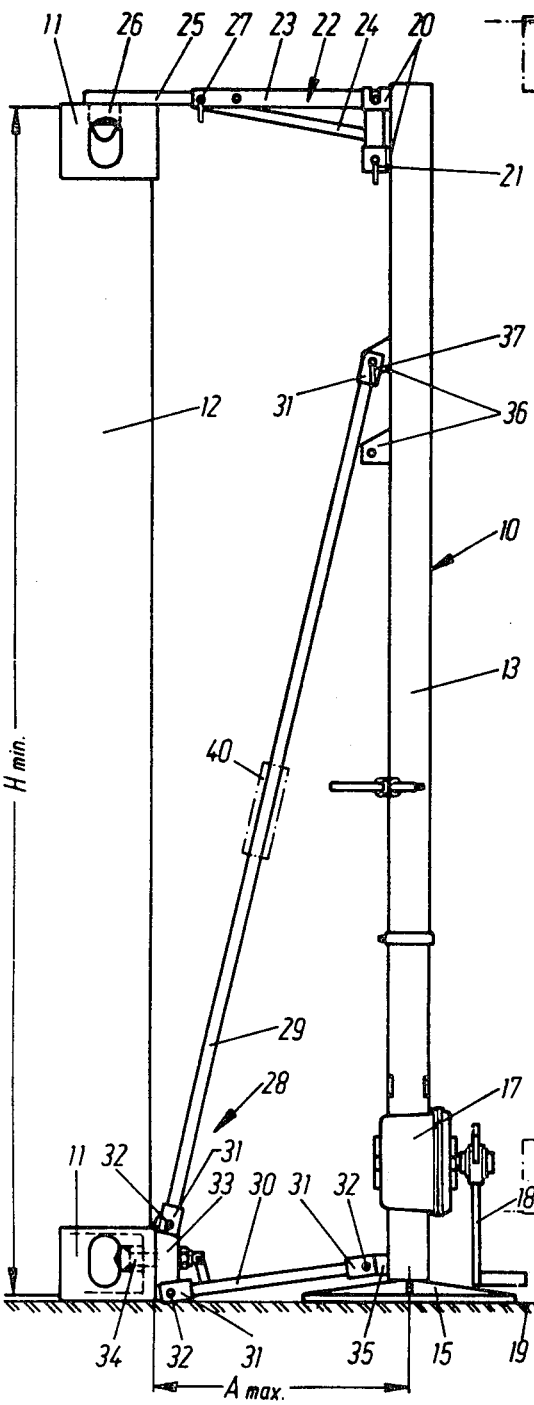
FIG. 3 is a side elevational view of the rack jack of FIGS. 1 and 2 in operative position in connection with part of a container of minimum height.

For use of rack jack 10 on a container 12 with height H min, the upper arm 22 is first fastened to jack shaft 13 as described above, and rod 25 is brought into its extreme extended position as in FIG. 3 and locked by means of bolt 27 in rod 23. Then arm 28 is brought into the working position shown in FIG. 3, where U-shaped strap 31 on the end of rod 29, released from shackle 20, is connected with upper shackle 36 by means of bolt 37. Next jack 10 is associated with the container, whereby it is first set perpendicularly on ground 19 and by actuation of crank drive 17, by means of hand crank 18, shaft 13 is raised until the pinlike engaging part 26 can be introduced from above into an upper corner fitting 11. After engaging part 26 has been introduced, the crank drive is reversed a little until rod 25 of upper arm 22 is applied to the associated corner fitting 11, and in this position the pin like engaging part 34 on lower arm 28 can now be laterally introduced into the associated lower corner fitting 11 and clamped there in the known way. At this time, rod 29 of lower arm 28 runs obliquely upward against jack shaft 13 while the other rod 30 extends almost perpendicularly against the shaft. The distance between the jack axis and the opposite side wall of container 12 in this case is A max. (FIG. 3). It is further to be observed that in this case rack jack 10 is completely retracted.

To adapt rack jack 10 to container 12' with height H max, first shaft 13 is driven up by actuation of crank drive 17 by the distance H max-H min (FIG. 4) and then the pin-like engaging parts 26 and 34 are engaged with their associated corner fittings 11 as described above. Rod 25 is brought into its farthest inward position and locked in rod 23 by bolt 27, while rods 29 and 30 of lower arm 28 assume the working position shown in FIG. 4, and the distance between the jack axis and the opposite side wall of container 12' is A min. Here the U-shaped strap 31 is connected to the upper end of rod 29 with lower shackle 36. If in this way all four rack jacks 10 are used on corner fittings 11 of container 12', the said container can be raised and again lowered, or supported on jack 10 in the raised position.

As soon as rack jacks 10 are separated from container 12 or 12', and are no longer in use, bolts 37 are loosened and pulled out so that the upper end of rod 29 is free and rods 29 and 30 can then be brought into the somewhat extended storing position of FIGS. 1 and 2, where they run close to shaft 13. In this way, as already mentioned, U shaped strap 31 on the upper end of rod 29 is connected by means of bolt 21 with lower shackle 20.

To secure rods 29 and 30 in the storing position illustrated in FIGS. 1 and 2, there is a clamping strap 41 provided on jack shaft 13, which at the same time constitutes the retaining device for hand crank 18, whose handle part can be folded down. FIGS. 1 and 2 further show that upper arm 22, after separation from shackle 20, can also be detachably fastened, for storage, on the lower part of shaft 13, so that a compact unit is obtained that for instance can be received by suitable holding means on the front wall of a container, a cabin, a shelter, etc. (not illustrated).

In contrast to the illustrated examples of the present invention, it is also possible to make rod 29 of lower arm 28, which runs obliquely upward against shaft 13 in the working position, so that it will telescope, and the telescoping rod parts can be opposedly clamped in their respective setting positions by known means.

What is claimed is:

1. Rack jack for hoisting, lowering and/or supporting containers, cabins, shelters, exchangeable superstructures or the like, having upper and lower corner fittings, said rack jack comprising an upwardly extending jack shaft (13), means for moving said jack shaft upwardly, an upper arm (22) mounted on the jack shaft and having an engaging part (26) at its outer end for engaging an adjacent upper corner fitting, a lower arm (28) mounted on the jack shaft and having an engaging part (34) at its outer end for engaging an adjacent lower corner fitting, each of said arms comprising a pair of supporting rods of different length connected at their inner ends to the jack shaft and at their outer ends to the engaging parts, the engaging part (26) for the upper corner fitting being adjustable substantially parallel to the axis of the jack shaft and substantially transversely to the jack shaft axis, and the engaging part (34) for the lower corner fitting being adjustable substantially perpendicularly with reference to the jack shaft axis, characterized in that the two rods (29, 30) of the lower arm (28) that is associated with a lower corner fitting (11) are articulatedly connected respectively with the jack shaft (13) and the engaging part (34), and in that the longer rod (29) in the working position runs obliquely against the jack shaft (13), the jack shaft is provided with a plurality of mutually spaced articulation points (36) in the upper half thereof to which the inner end of the longer rod (29) may be connected, and in that the total length of the two rods, (29, 30) of the lower arm (28) does not exceed, or does not substantially exceed, the height of the jack shaft (13).

2. Rack jack as in claim 1, characterized in that the articulation points (36) are disposed in the upper third of the jack shaft (13).

3. Rack jack as in claim 1, further comprising shackles at the upper end of the jack shaft for detachable fixation of the upper arm, characterized in that the total length of the two rods (29, 30) of the lower arm (28) is such that when the upper arm (22) is removed and rods (29, 30) of the lower arm are brought into a somewhat extended storage position, in which the said rods (29, 30) run closely against the jack shaft (13), the upper end of the longer rod (29) of the lower arm (28) is detachably held by a shackle (20) on the upper end of the jack shaft (13).

4. Rack jack as in claim 3, characterized in that a clamping arcuate member (41) is mounted on the jack shaft to secure the rods (29, 30) of the lower arm (28) in the somewhat extended position of storage on the jack shaft (13).

5. Rack jack as in claim 4 wherein the jack shaft comprises a hand crank (18) and crank drive (17), and said clamping arcuate member (41) serves as a retainer for said hand crank.

6. Rack jack for hoisting, lowering and/or supporting containers cabins, shelters, exchangeable superstructures or the like, having upper and lower corner fittings, said rack jack comprising an upwardly extending jack shaft (13), means for moving said jack shaft upwardly, an upper arm (22) mounted on the jack shaft and having an engaging part (26) at its outer end for engaging an adjacent upper corner fitting, a lower arm (28) mounted on the jack shaft and having an engaging part (34) at its outer end for engaging an adjacent lower corner fitting, each of said arms comprising a pair of supporting rods of different length connected at their inner ends to the jack shaft and at their outer ends to the engaging parts, the engaging part (26) for the upper corner fitting being adjustable substantially parallel to the axis of the jack shaft and substantially transversely to the jack shaft axis, and the engaging part (34) for the lower corner fitting being adjustable substantially perpendicularly with reference to the jack shaft axis, characterized in that the two rods (29, 30) of the lower arm (28) that is associated with a lower corner fitting (11) are articulatedly connected respectively to the jack shaft (13) and the engaging part (34), and in that for the longer rod (29) in the working position runs obliquely against the jack shaft (13), the jack shaft being provided with an articulation point (36) in the upper half thereof, and the rod (29) being variable in its length.

7. Rack jack as in claim 6, characterized in that the rod (29) of the lower arm (28) that in its working position runs obliquely upward against the jack shaft is composed of two parts connected by a turnbuckle (40).

8. Rack jack as in claim 6, characterized in that the rod (29) of the lower arm (28) that in its working position runs obliquely upward against the jack shaft is formed of telescoping parts, and means are provided to lock said telescoping parts in selected positions.

* * * * *